US005592268A

United States Patent [19]

Uehara et al.

[11] Patent Number: 5,592,268

[45] Date of Patent: Jan. 7, 1997

[54] MECHANISM TO PREVENT TONER LEAKAGE FROM AN IMAGE FORMING UNIT

[75] Inventors: Mitsuyoshi Uehara, Nagoya; Hideo Yoshihara, Toki; Tsutomu Suzuki, Nagoya; Fumio Morita, Nagoya; Hiroshi Igarashi, Nagoya, all of Japan

[73] Assignee: Brother Kogyo Kabushiki Kaisha, Nagoya, Japan

[21] Appl. No.: 494,558

[22] Filed: Jun. 22, 1995

[30] Foreign Application Priority Data

Jul. 22, 1994 [JP] Japan ..... 6-170633
Jul. 22, 1994 [JP] Japan ..... 6-170634

[51] Int. Cl.[6] ..... G03G 15/09

[52] U.S. Cl. ..... 399/276; 399/163

[58] Field of Search ..... 355/215, 245, 355/251, 259; 118/653, 656, 657, 658

[56] References Cited

U.S. PATENT DOCUMENTS

| | | | |
|---|---|---|---|
| 4,676,192 | 6/1987 | Yuge et al. . | |
| 5,057,868 | 10/1991 | Sekino et al. | 355/215 |
| 5,084,733 | 1/1992 | Katoh et al. | 355/251 |
| 5,134,960 | 8/1992 | Shirai | 118/653 |
| 5,166,733 | 11/1992 | Eliason | 355/251 |
| 5,172,166 | 12/1992 | Funayama | 355/215 |
| 5,177,536 | 1/1993 | Watanabe et al. | 355/251 |
| 5,187,326 | 2/1993 | Shirai et al. | 118/657 |
| 5,212,521 | 5/1993 | Ogawa et al. | 355/215 |
| 5,475,467 | 12/1995 | Watanabe et al. | 355/215 X |
| 5,488,462 | 1/1996 | Ishikawa et al. | 355/215 |

FOREIGN PATENT DOCUMENTS

| | | | |
|---|---|---|---|
| 55-113074 | 9/1980 | Japan | 355/215 |
| 61-230176 | 10/1986 | Japan | 355/215 |
| 62-192768 | 8/1987 | Japan | 355/215 |
| 62-192769 | 8/1987 | Japan | 355/215 |
| 62-208872 | 9/1987 | Japan | 355/215 |
| 62-208073 | 9/1987 | Japan | 355/215 |
| 63-311284 | 12/1988 | Japan | 355/215 |
| 4-48232 | 8/1992 | Japan . | |
| 4-73794 | 11/1992 | Japan . | |
| 4-317087 | 11/1992 | Japan | 355/245 |
| 4-317086 | 11/1992 | Japan | 355/245 |
| 4-345181 | 12/1992 | Japan | 355/245 |
| 4-355778 | 12/1992 | Japan | 355/245 |
| 5-2321 | 1/1993 | Japan | 355/245 |
| 5-2322 | 1/1993 | Japan | 355/245 |
| 5-181354 | 7/1993 | Japan | 355/245 |
| 6-11958 | 1/1994 | Japan | 355/245 |

*Primary Examiner*—R. L. Moses
*Attorney, Agent, or Firm*—Oliff & Berridge

[57] ABSTRACT

An image forming unit includes structure to prevent leakage of initial developer containing magnetic carrier and magnetic toner from a case. The image forming unit includes a photoconductive drum, a developing sleeve, and a trimming blade. Auxiliary sealing members are attached to the opposite ends of the trimming blade to stop up gaps between side sealing members in sliding contact with the opposite ends of the developing sleeve, and a protective sheet is removably inserted in the gap between the developing sleeve and the trimming blade. Ferromagnetic strips capable of being magnetized by the magnet roller are attached to the reverse side of the protective sheet at the opposite sides of one end of the protective sheet. The ferromagnetic strips magnetically attract the developer that is about to leak through the gaps to completely prevent leakage of the developer.

18 Claims, 13 Drawing Sheets

29a
29b
29
17
18
13
33
25
54
55
57
58
62
43
S

MECHANISM TO PREVENT TONER LEAKAGE FROM AN IMAGE FORMING UNIT

BACKGROUND OF THE INVENTION

1. Field of the Invention

The present invention relates to an image forming unit for an electrophotographic image forming apparatus, such as a copying machine, a facsimile, a printer or the like, comprising an image forming mechanism including a photoconductive drum and a developing roller, a case containing the image forming mechanism so that the developer containing toner and magnetic carrier may not leak from the case during transportation, and a protective covering for the image forming unit.

2. Description of the Related Art

FIGS. 11 to 13 show a developing device of a dry developing system that supplies a developer to the developing region in the circumference of a photoconductive drum, disclosed in U.S. Pat. No. 4,676,192 and Japanese Laid-Open Patent Publication No. Hei 4-48232. This developing device has a developing device case 101 defining a developer chamber 102 containing an initial developer, i.e., a developing mixture of magnetic carrier and magnetic toner, a developing sleeve 104 for carrying the developing mixture, internally provided with a magnet roller 103, and a first toner stirring member 105.

A partition wall 106a separating the developer chamber 102 and a toner supply chamber 106 from each other is provided with a toner supply slit 107 extending parallel to the axis of the developing sleeve 104 and opening into the developer chamber 102. A second stirring member 108 for supplying the toner through the toner supply slit 107 into the developer chamber 102 is disposed in the toner supply chamber 106.

As shown in FIG. 11, a trimming blade 109 is attached to the front wall 101*b* of the developing device case 101 so that the gap S between the edge of the trimming blade 109 and the outer surface of the developing sleeve 104 is adjustable to form a magnetic brush of a predetermined height on the outer surface of the developing sleeve 104. In an image forming operation, the toner is applied to the circumference of the photoconductive drum 100 by the developing sleeve 104.

If the developing mixture containing the toner and the magnetic carrier leaks from the developing device case 101, the photoconductive drum 100 and a recording sheet fed to the developing device may be soiled, and the developing mixture is wasted. Therefore, as shown in FIGS. 11 to 13, semicircular recesses 110 corresponding to half the circumference of the developing sleeve 104 are formed in the opposite sealing walls 101*a* (only one of them is shown in FIG. 12) and strip-shaped side sealing members 111 of felt or the like are placed between the surfaces of the semicircular recesses 110 and the circumference of the developing sleeve 104, respectively, to seal the developer chamber 102.

However, since the width H0 of the side sealing members 111 in sliding contact with the opposite ends (only one of them is shown in FIG. 13) of the circumference of the developing sleeve 104 is comparatively large and the inner portions of a width H1 of the side sealing members 111 correspond to the magnet roller 103, respectively, as shown in FIG. 13, the following problems arise.

The magnetic carrier and the magnetic toner are attracted to the circumference of the developing sleeve 104 in a layer of an appropriate thickness by the magnetic force of the magnet roller 103. When the developing sleeve 104 rotates, the magnetic carrier and the magnetic toner adhering to the opposite ends of the circumference of the developing sleeve 104 rub against the side edges of the fixed side sealing members 111. Since the developer, i.e., the mixture of the magnetic carrier and the magnetic toner, is attracted by magnetic force to the circumference of the developing sleeve 104, hairs of the felt forming the side sealing members 111 are torn off and scatter, the torn hairs adhering to the developing sleeve 104 and the associated parts, thereby adversely affecting the image forming operation. During a long period of use, the side sealing members 111 are abraded by the magnetic carrier and the magnetic toner, and their sealing effect deteriorates. Consequently, the gaps at the opposite ends of the circular surface of the developer chamber 102 develop gradually with the operating time, and finally, the side sealing members 111 become unable to prevent leakage of the magnetic carrier and the magnetic toner from the developing device case 101.

Furthermore, the magnetic carrier and the magnetic toner adhering to portions of the surface of the developing sleeve 104 in sliding contact with the side sealing members 111 are pressed continuously against the surface of the developing sleeve 104, and consequently, the magnetic toner sticks to the surface of the developing sleeve 104. The magnetic toner sticking to the surface of the developing sleeve 104 may be transferred accidentally from the developing sleeve 104 to the photoconductive drum 100, forming dark stripes in the side margins of the recording sheet.

These problems are unavoidable as long as the side sealing members 111 are disposed in ranges around the opposite ends of the circumference of the developing sleeve 104, subject to the influence of magnetic fields created around the opposite ends of the magnet roller 103.

SUMMARY OF THE INVENTION

The present invention has been made in view of the aforesaid problems, and it is therefore an object of the present invention to provide an image forming unit capable of preventing the leakage of developer therefrom and a protective covering for the image forming unit.

In a first aspect of the present invention, an image forming unit is provided having a developing device case having an open chamber facing the circumference of a photoconductive drum and a cylindrical developing sleeve internally provided with a magnet roller. The cylindrical developing sleeve is supported for rotation with its axis parallel to the axis of the photoconductive drum within the open chamber of the developing device case. The magnet roller is disposed so that regions subject to the magnetism of the magnet roller are on the inside of positions at a suitable distance from the opposite ends of the developing sleeve. Substantially semicircular recesses are formed in the opposite sealing walls of the developing device case at positions corresponding to the open chamber, respectively. Side sealing members are placed on the surfaces of the substantially semicircular recesses in sliding contact with half the circumferences of the opposite ends of the developing sleeve in regions outside the regions subject to the influence of the magnetism of the magnet roller opposite ends or in regions where the attractive effect of the magnetism of the magnet roller is insignificant, respectively.

In this image forming unit, the abrasion of the fixed side sealing members by the developer, i.e., a mixture of magnetic carrier and magnetic toner, attracted to the circumference of the developing sleeve and adhering to the same can be avoided. Thus, the image forming unit of the present invention solves the problems in the prior art developing device, in which the side sealing members are disposed within ranges subject to the attractive effect of the magnetism of the magnet roller; the side sealing members are abraded by the developer firmly adhering to the circumference of the developing sleeve; scattered fragments of the side sealing member adversely affect the image forming operation; the side edges of the side sealing members are abraded by the developer in a long period of operation; and the side sealing members are unable to function effectively for sealing. The magnetic carrier and the magnetic toner do not adhere and stick to portions of the circumference of the developing sleeve in sliding contact with the side sealing members, and hence, black stripes are not formed on the recording sheet.

Consequently, a satisfactory image can be formed, the life of the side sealing members is extended, the side sealing members are able to function effectively for sealing, and the quality of the image is not deteriorated. Furthermore, since the regions subject to the attractive effect of the magnet roller can be easily determined by properly determining the respective positions of the opposite ends of the magnet roller fitted in the developing sleeve relative to the respective position of the side sealing members, the present invention does not require any additional manufacturing cost.

In a second aspect of the present invention, an image forming unit is provided having a developing device case having an open chamber facing the circumference of a photoconductive drum, a cylindrical developing sleeve internally provided with a magnet roller and supported for rotation with its axis parallel to the axis of the photoconductive drum within the open chamber of the developing device case, and a trimming blade disposed to form a gap of an appropriate size between the circumference of the developing sleeve and the edge thereof. Substantially semicircular recesses are formed in the opposite sealing walls of the developing device case at positions corresponding to the open chamber. Side sealing members in sliding contact with half the circumferences of the opposite ends of the developing sleeve, respectively, are placed on the semicircular surfaces of the substantially semicircular recesses. Auxiliary sealing members are attached to the trimming blade to overlap the side sealing members, respectively.

In this image forming unit, a space surrounded by the circumference of the developing sleeve, the edge of each side sealing member and the edge of the trimming blade is filled up with the auxiliary sealing member attached to the trimming blade to overlap the corresponding side sealing member. Therefore, leakage of the developer from the developing device case during transportation can be prevented.

In a third aspect of the present invention, in the image forming unit, the side sealing members are disposed outside the regions subject to the attractive effect of the magnetism of the opposite ends of the magnet roller or in regions scarcely subject to the magnetism of the opposite ends of the magnet roller, and the auxiliary sealing members are attached to the trimming blade at positions inside the side sealing members, respectively.

In a fourth aspect of the present invention, a protective covering for the image forming unit in any one of the foregoing aspects of the present invention prevents leakage of the initial developer contained in the developing device case from an outer case containing the photoconductive drum and the developing device case containing the initial developer for transportation during transportation. The protective covering comprises a protective sheet capable of being removably inserted in the gap between the trimming blade and the developing sleeve and ferromagnetic strips capable of being attracted by the magnetism of the magnet roller and attached to one edge of the protective sheet.

When the edge of the protective sheet is brought near the gap between the trimming blade and the circumference of the developing sleeve in wrapping the image forming unit with the protective sheet, the ferromagnetic strips attached to the edge of the protective sheet are attracted to the developing sleeve by the magnetism of the magnet roller fitted in the developing sleeve. Then, the protective sheet is moved along the surface of the developing sleeve. Thus, the edge of the protective sheet can be easily attached. Scatter of the developer during transportation can be prevented because the gap between the developing sleeve and the trimming blade is blocked with the protective sheet, and the ferromagnetic strips are attracted magnetically by the magnet roller so that the protective sheet may not readily come off the developing sleeve. Even if the developer attempts to leak through gaps around the ferromagnetic strips in a mist, the developer is attracted to the ferromagnetic strips magnetically and is unable to leak outside.

BRIEF DESCRIPTION OF THE DRAWINGS

A preferred embodiment of the present invention will be described in detail with reference to the accompanying drawings, wherein.

DETAILED DESCRIPTION OF PREFERRED EMBODIMENTS

Figure 1:
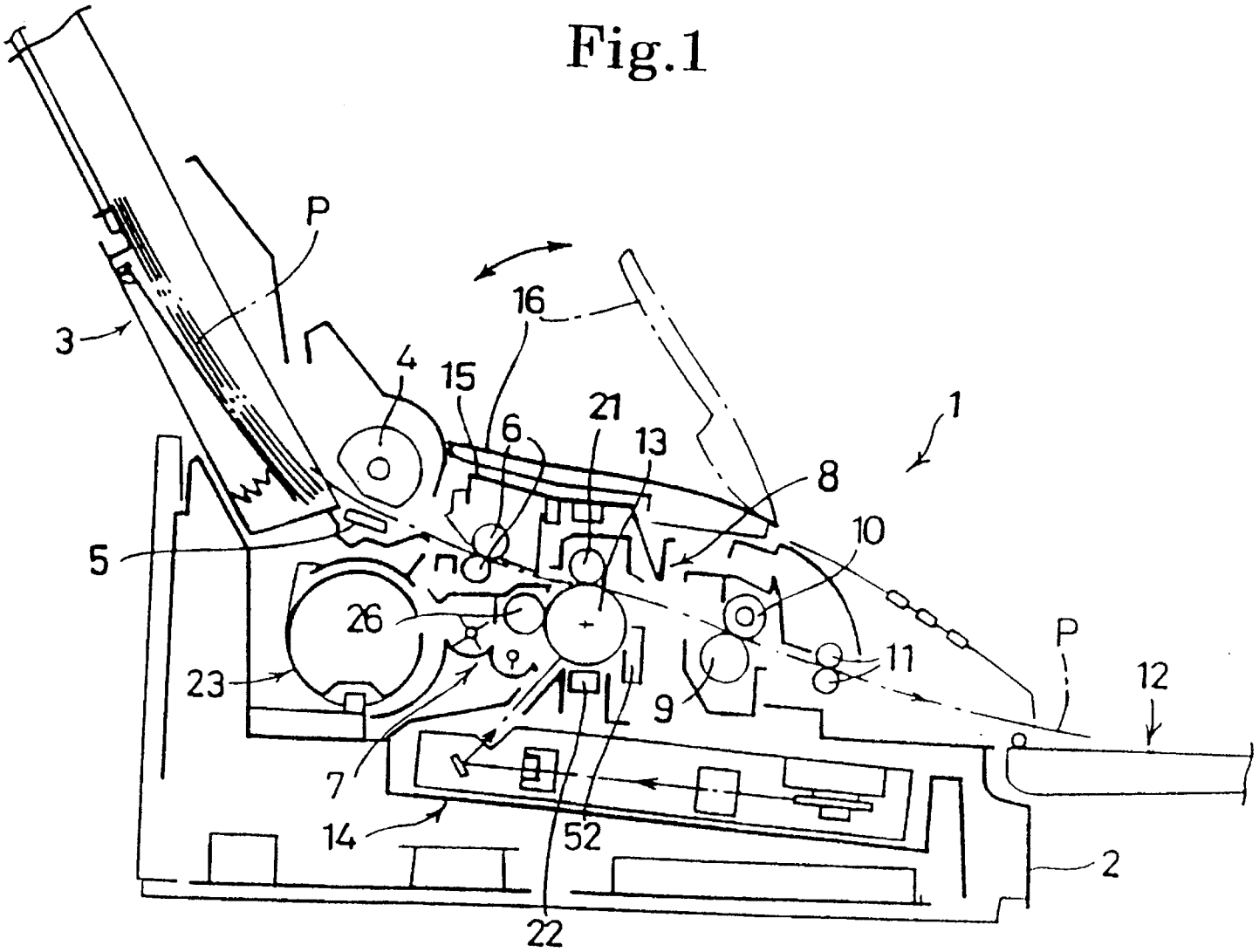
FIG. 1 is a schematic sectional view of a printer.

An image forming unit in a preferred embodiment according to the present invention will be described with reference to FIGS. 1, 2 and 3. Referring to FIG. 1 showing a printer 1, i.e., an image forming apparatus, a paper feed cassette 3 is detachably attached to the upper part of one end of a main case 2, recording sheets P, i.e., recording media, stacked in the paper feed cassette 3 are fed one at a time by the cooperative action of a known feed roller 4 and a known separating pad 5, and each recording sheet P is conveyed to an image forming unit 8 by a pair of conveyor rollers 6.

The image forming unit 8 comprises a developing device 7, a photoconductive drum 13, a transfer roller 21, a charger 22, a toner cartridge 23 and a cleaning device 52. A scanning unit 14 comprising a laser light source, a lens system, reflecting mirrors and the associated parts is disposed under the image forming unit 8. A control unit and a power supply unit are disposed under the scanning unit 14.

The circumference of the photoconductive drum 13 is charged by the charger 22, the charged circumference of the photoconductive drum 13 is scanned with a laser beam emitted by the scanning unit 14 according to image data given to the scanning unit 14 from an external device, such as a computer, not shown, to form an electrostatic latent image on the circumference of the photoconductive drum 13. A developing sleeve 18 of a metal, such as aluminum, internally provided with a magnet roller 17 and included in a developing device 7 is rotated in the direction of the arrow A shown in FIG. 2, whereby frictionally charged toner particles are transferred from the developing sleeve 18 to the photoconductive drum 13 to develop the electrostatic latent image in a visible toner image. The toner image is transferred from the photoconductive drum 13 to the recording sheet P moved to the nip line between the transfer roller 21 and the photoconductive drum 13. A fixing unit disposed immediately behind the image forming unit 8 compresses the toner image between a heating roller 9 and a pressure roller 10 and heats the toner image by the heating roller 9 to fix the toner image to the recording sheet P. The recording sheet P carrying the fixed toner image is then delivered to a delivery tray 12 by a pair of delivery rollers 11, 11.

A swing cover 15 is supported pivotally on the upper part of the image forming unit 8, and a swing cover 16 for covering the cover 15 and the image forming unit 8 is supported pivotally on the upper wall of the main case 2.

This embodiment may use either a 2-component developing system using a developer containing 95 to 98 wt.% magnetic carrier and 2 to 5 wt.% nonmagnetic toner or a 1.5-component developing system using a developer containing 30 to 80 wt.% magnetic carrier and 20 to 70 wt.% magnetic toner.

The construction of the image forming unit 8 will be described hereinafter with reference to FIGS. 2 to 4.

The image forming unit 8 comprises the photoconductive drum 13, the transfer roller 21 disposed in contact with the upper part of the circumference of the photoconductive drum 13, the charger 22 disposed under the photoconductive drum 13, the developing device 7 disposed upstream of the photoconductive drum 13 with respect to the direction of travel of the recording sheet P, a developer supply unit for supplying a developer consisting of the magnetic carrier and the magnetic toner, including a detachable toner cartridge 23, the developer supply unit being disposed upstream of the developing device 7 with respect to the direction of travel of the recording sheet P, and the cleaning device 52 disposed downstream of the photoconductive drum 13 with respect to the direction of travel of the recording sheet P. An electrostatic latent image is formed in a charged layer formed in the circumference of the photoconductive drum 13 by the charger 22 by scanning the charged layer on the photoconductive drum 13 with the laser beam emitted by the scanning unit 14. The developer delivered from the toner cartridge 23 is stirred sequentially by a first stirring blade 24 and a second stirring blade 25 and adheres to the circumference of the developing sleeve 18. The developer is transferred from the developing sleeve 18 to the electrostatic latent image formed on the photoconductive drum 13 to develop the electrostatic latent image in a visible toner image. The toner image is transferred from the photoconductive drum 13 to the recording sheet P, which is being moved by the photoconductive drum 13 and the transfer roller 21. The developer remaining on the photoconductive drum 13 after the toner image has been transferred to the recording sheet P is recovered by the cleaning device 52.

The image forming unit 8 is encased in an outer case 28 and a developing device case 29 encased in the outer case 28 to form an image forming unit. The image forming unit 8 is removably placed in the main case 2.

Figure 2:
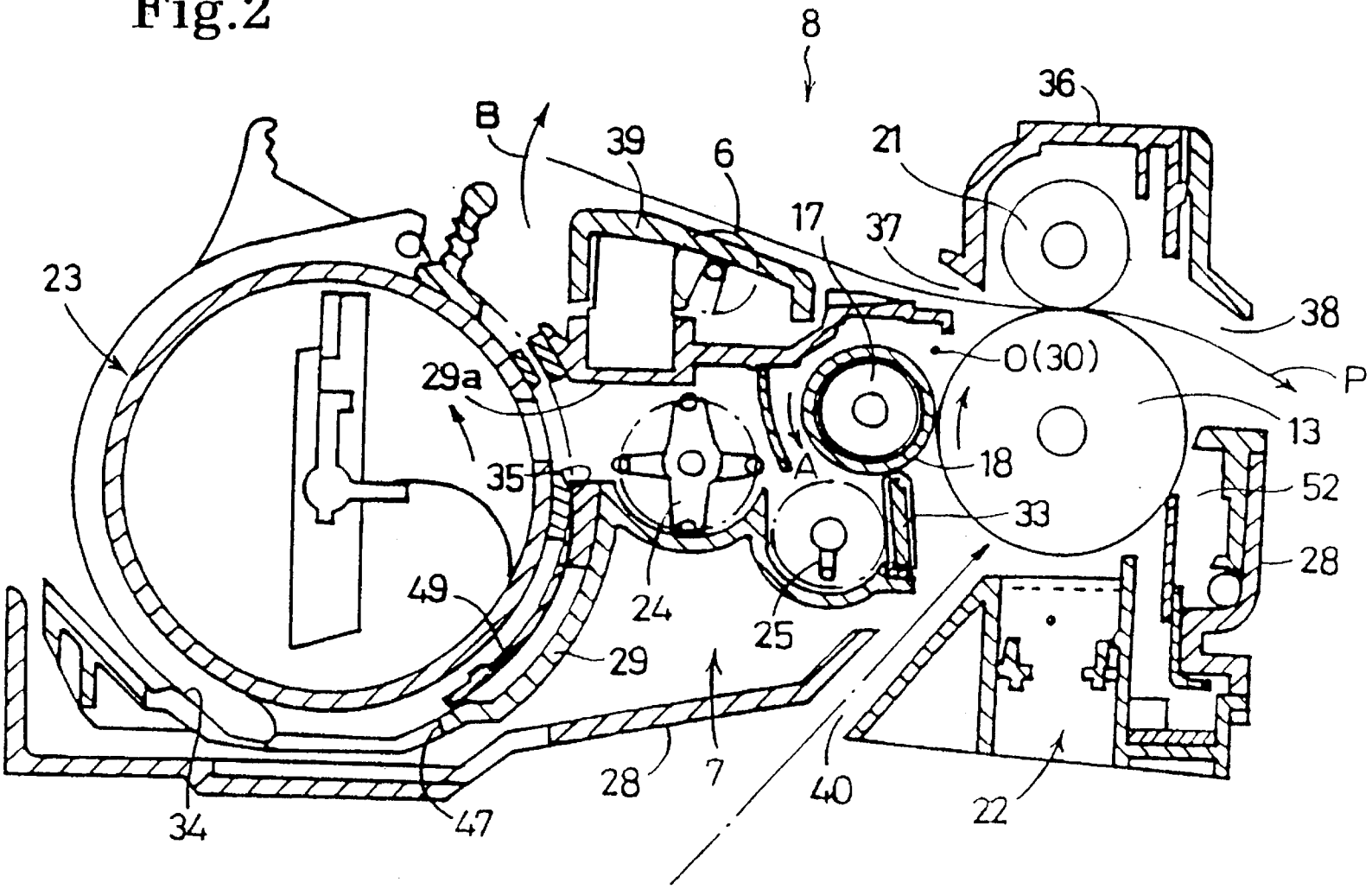
FIG. 2 is an enlarged sectional side view of a portion of the printer of FIG. 1.
Figure 3:
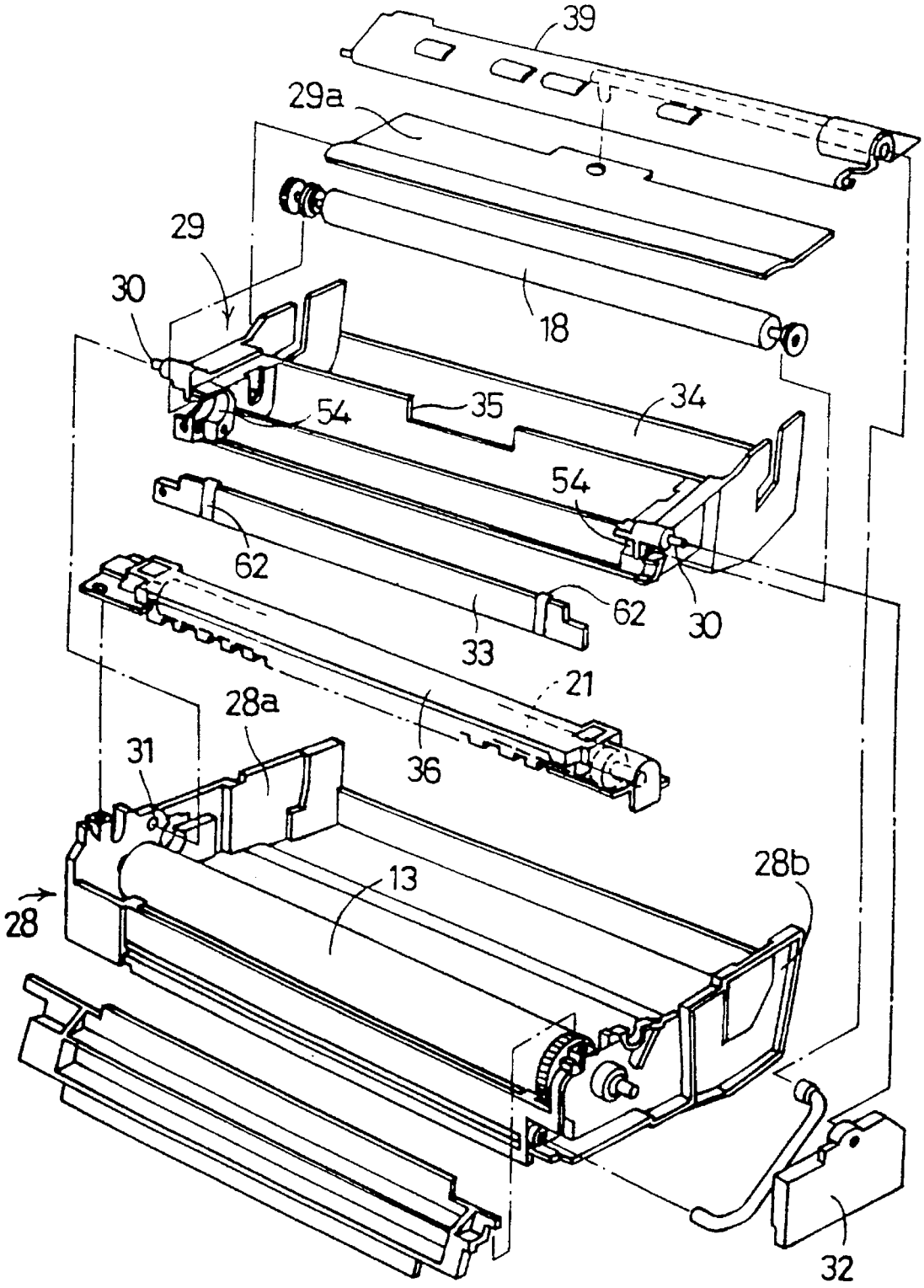
FIG. 3 is an exploded perspective view of an image forming unit.

As shown in FIG. 3, a pair of pivots 30, 30 horizontally projecting from the opposite ends of the upper front part of the developing device case 29 on the side of the developing sleeve 18 are fitted in a round hole 31 formed in one side plate **28*a* of the outer case 28 rotatably supporting the photoconductive drum 13 and a round hole formed in a side case 32 attached to the other side wall 28*b* of the outer case 28, respectively, so that the developing device case 29 is able to turn on the pivots 30, 30 in a vertical plane in the direction of the arrow B shown in FIG. 2 relative to the outer case 28. The charger 22 and the cleaning device 52 are mounted on the outer case 28**.

The developing device 7 is encased in the developing device case 29. The first stirring blade 24 and the second stirring blade 25 are supported for rotation on the developing device case 29.

A toner cartridge chamber 34 is formed in the developing device case 29 on the opposite side of a trimming blade 33 with respect to the first stirring blade 24. An elongate recess 35 is formed in the front wall of the toner cartridge chamber 34 to supply the magnetic toner and the magnetic carrier from the toner cartridge 23 into a stirring chamber in which the first stirring blade 24 stirs the mixture of the magnetic toner and the magnetic carrier.

A protective member 36 is extended across the opposite side walls **28*a* and 28*b* of the outer case 28 to cover the transfer roller 21. The lower end of the rear wall of the protective member 36 and the upper wall 29*a* of the developing device case 29 define a sheet inlet opening 37, and the lower end of the front wall of the protective member 36 and the upper wall of the cleaning device 52 define a sheet outlet opening 38. The sheet inlet opening 37 and the sheet outlet opening 38 are on a sheet passage passing the contact line between the photoconductive drum 13 and the transfer roller 21**.

A guide member 39 is disposed on the upper wall **29*a* of the developing device case 29 to guide the recording sheet P fed by the feed roller 4 through the sheet inlet opening 37 toward the contact line between the photoconductive drum 13 and the transfer roller 21. The lower conveyor roller 6 among the pair of conveyor rollers 6, 6 is supported for rotation on the guide member 39, and the upper conveyor roller 6 is supported for rotation on the swing cover 15**.

An exposure slot 40 through which the laser beam emitted by the scanning unit 14 (FIG. 1) travels for scanning toward the photoconductive drum 13 is formed in the bottom wall of the outer case 28 substantially parallel to the axis of the photoconductive drum 13.

Figure 4:
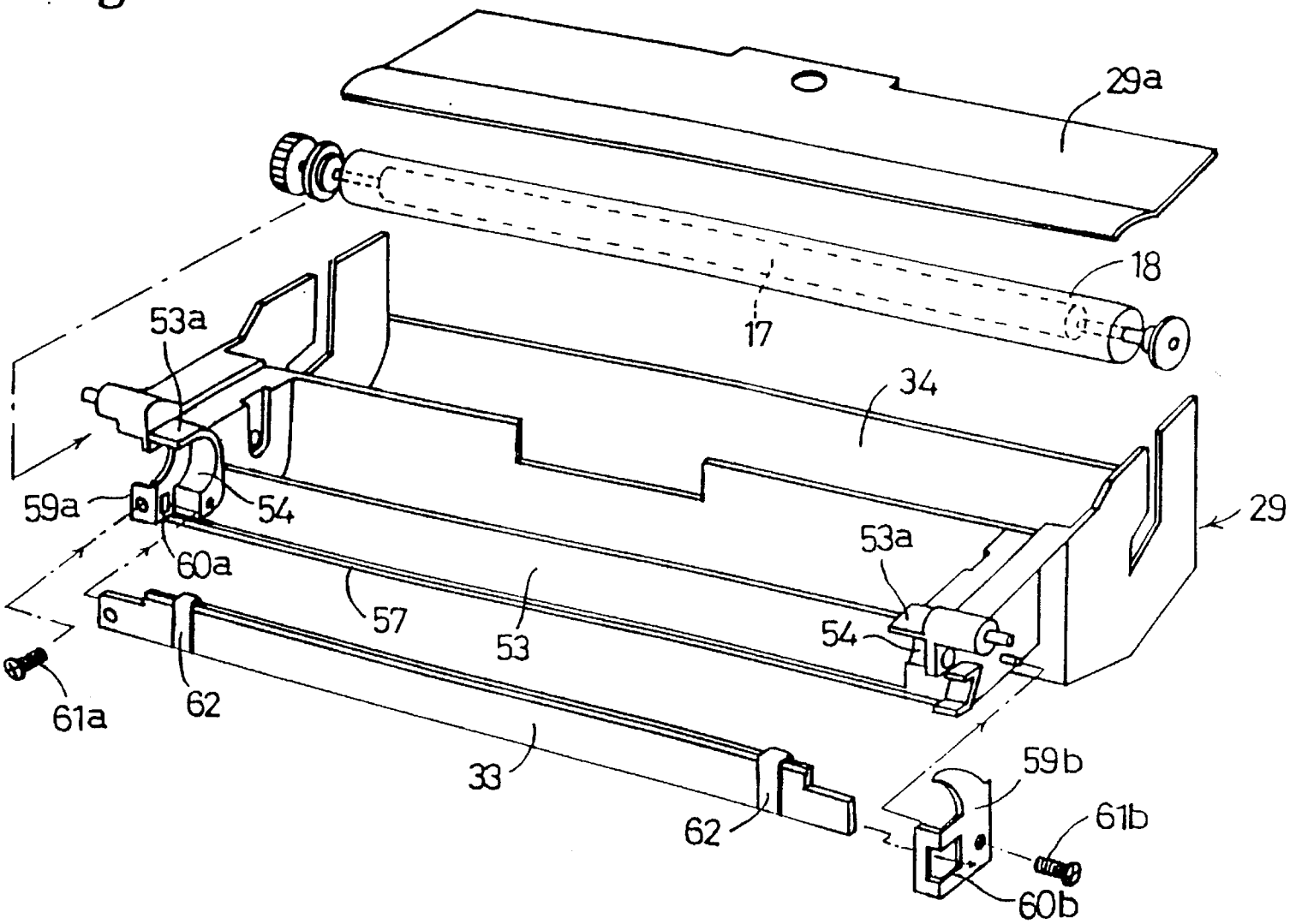
FIG. 4 is an exploded perspective view of a developing device case.

As shown in FIG. 4, the developing device case 29 containing the developing device 7 is provided with an elongate open chamber 53 opposite to the circumference of the photoconductive drum 13. The open chamber 53 extends parallel to the axis of the photoconductive drum 13. The developing sleeve 18 internally provided with the magnet roller 17 is put in the open chamber 53 and is supported for rotation on the developing device case 29 so that part of the circumference of the developing sleeve 18 faces the circumference of the photoconductive drum 13.

Figure 5:
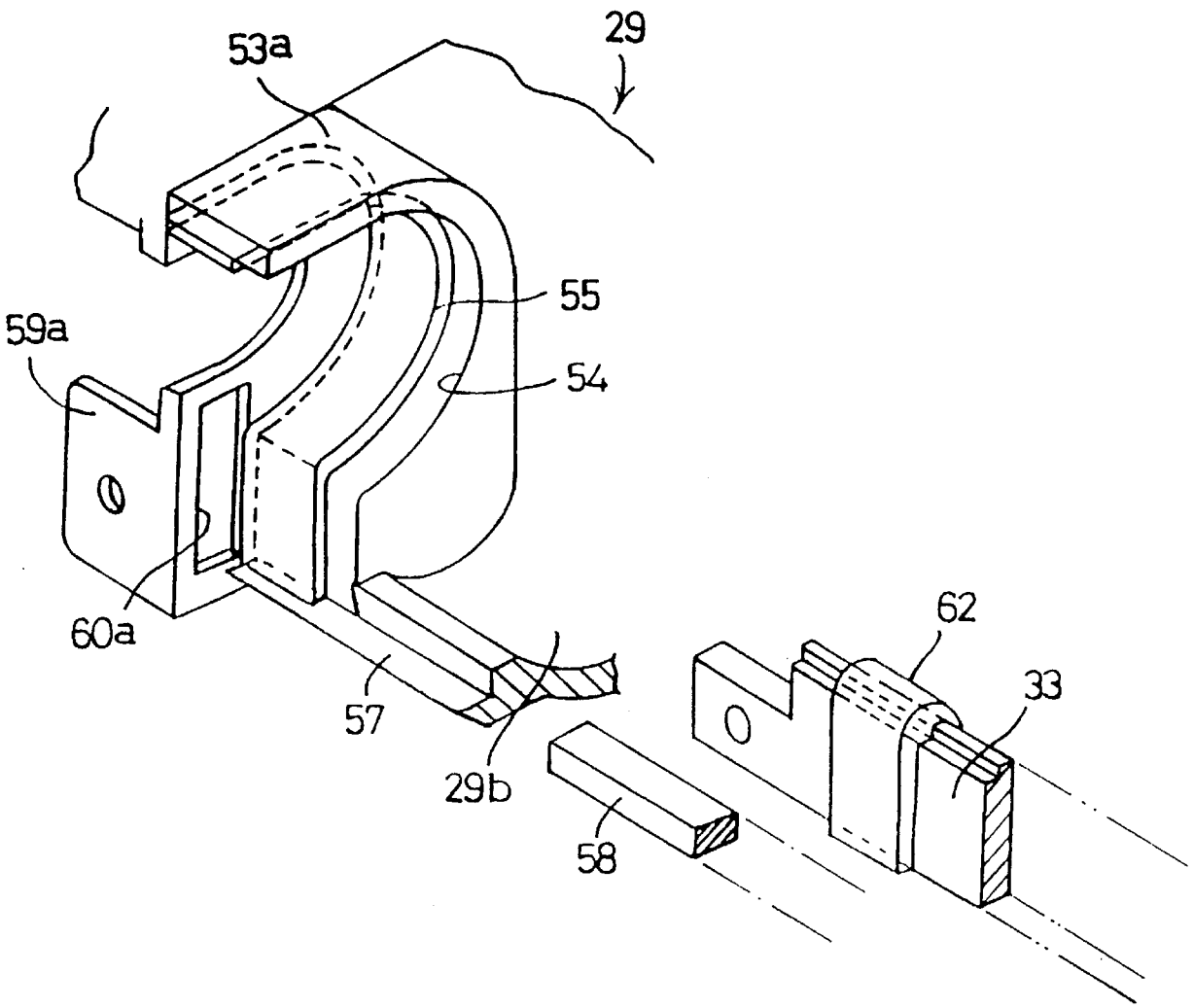
FIG. 5 is a fragmentary exploded perspective view of a portion of the developing device case, a portion of a trimming blade and the associated parts.
Figure 6:
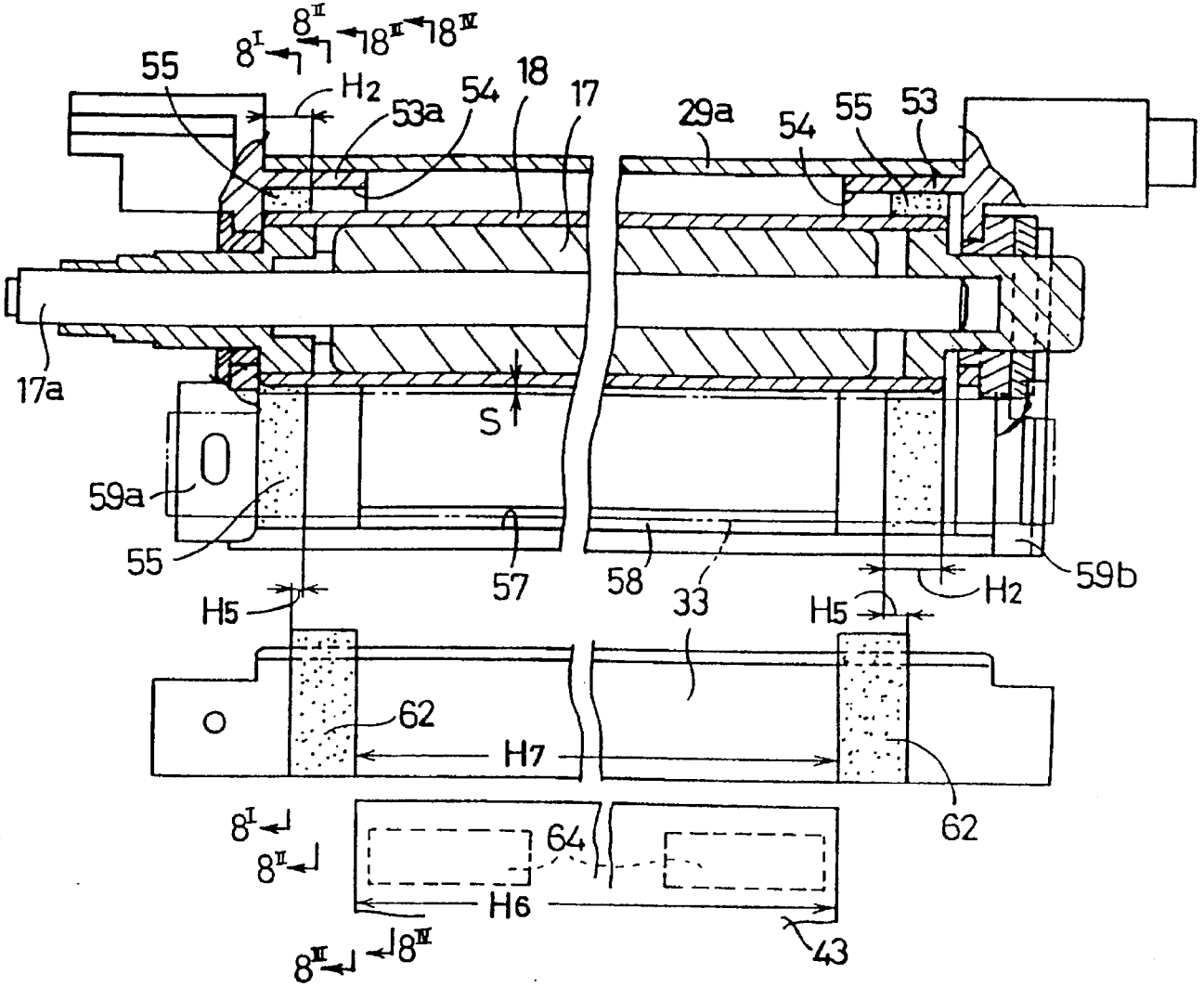
FIG. 6 is a part sectional view of a developing sleeve and the associated parts.

Substantially semicircular recesses 54 of a radius slightly greater than the outside radius of the developing sleeve 18 are formed in the opposite sealing walls 53*a*, 53*a* limiting the opposite ends of the open chamber 53 of the developing device case 29. As shown in FIGS. 5 and 6, a strip-shaped side sealing member 55, such as a felt strip, of H2 in width is attached adhesively to the surface of each recess 54.

Figure 7:
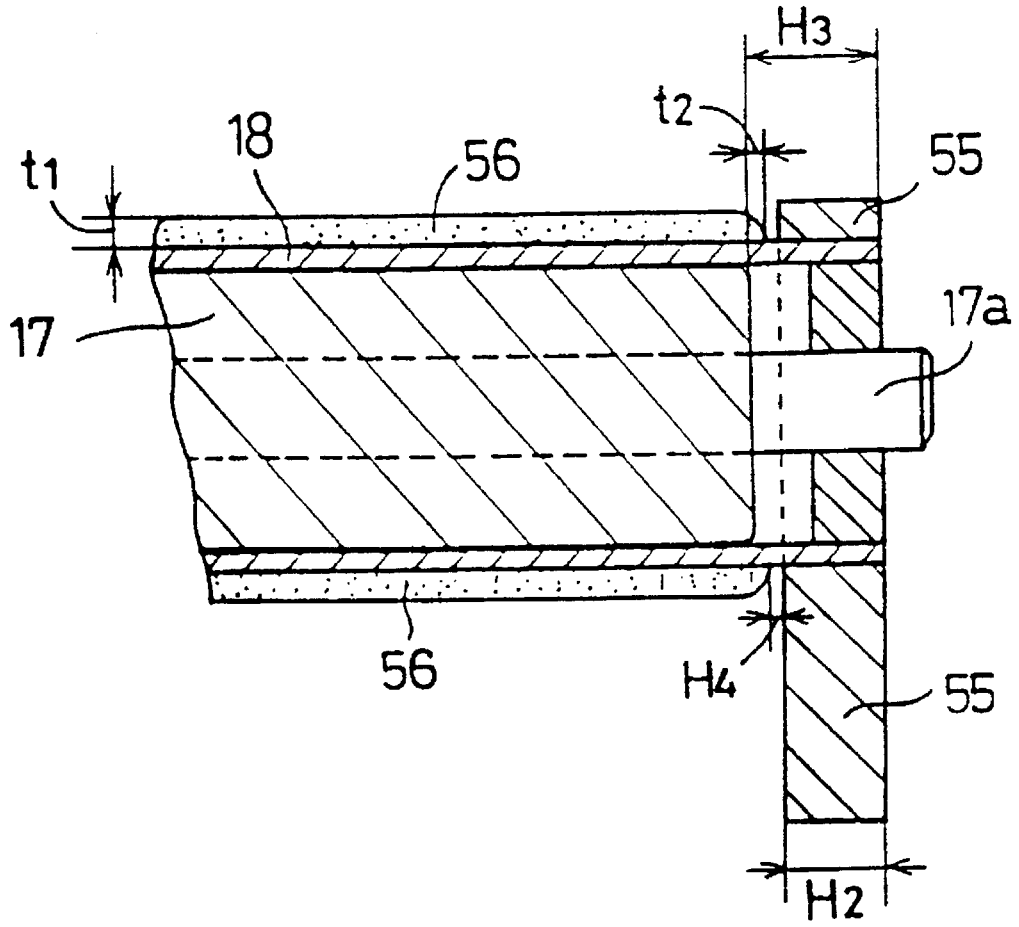
FIG. 7 is a fragmentary sectional view of the developing sleeve and the associated parts.

The length and the position of the magnet roller 17 relative to the developing sleeve 18 are determined so that regions subject to the magnetism of the opposite ends of the magnet roller 17 are on the inside of positions at a distance H3 (FIG. 7) greater than the width H2 from the opposite ends of the developing sleeve 18, respectively. As shown in FIG. 7, the thickness t1 of a layer of the developer 56 formed over the circumference of the developing sleeve 18 by attracting the magnetic carrier and the magnetic toner to the circumference of the developing sleeve 18 by the magnetism of the magnet roller 17 is on the order of 5 mm. The thickness of the layer of the developer 56 is substantially uniform over the entire length of the magnet roller 17. The length t2 of portions of the layer of the developer formed on portions of the developing sleeve 18 extending beyond positions corresponding to the opposite ends of the magnet roller 17, in which the attractive effect of the magnetism of the magnet roller 17 is relatively weak, is on the order of 1 mm.

Therefore, side sealing members 55 attached to the semicircular surfaces of the recesses 54 to be in sliding contact with the opposite ends of the developing sleeve 18 are outside the regions subject to the attractive effect of the magnetism of the opposite ends of the magnet roller 17. As shown in FIG. 7, a gap of a width H4 is formed between the inner side of each side sealing member 55 and the corresponding outer end of the layer of the developer, and hence, abrasion of the side surfaces of the side sealing members 55 by the developer 56, i.e., the mixture of the magnetic carrier and the magnetic toner, adhering to the circumference of the developing sleeve 18 and rotating together with the developing sleeve 18 can be avoided. Accordingly, hairs of the felt forming the side sealing members 55 are not torn off by the developer 56 firmly adhering to the circumference of the developing sleeve 18, any torn hairs do not scatter and adhere to the developing sleeve 18 to adversely affect the image forming operation, the side sealing members 55 are not abraded excessively rapidly, and the side sealing members 55 will not become ineffective in an excessively short period of operation.

Furthermore, the developer is prevented from adhering to the portions of the circumference of the developing sleeve 18 in sliding contact with the side sealing members 55 when the developer is pressed intensely against and caused to stick to the circumference of the developing sleeve 18 by the side sealing members.

Consequently, spoiling the image with hairs of the felt forming the side sealing members 55 and soiling the recording sheet with the developer sticking to the developing sleeve 18 can be obviated, the image can be formed in a satisfactory image quality, the life of the side sealing members is extended and the sealing effect of the side sealing members can be maintained for an extended period of operation.

Although the side sealing members 55 in this embodiment are disposed so that their inner sides are on the outside of the regions subject to the attractive effect of the magnetism of the magnet roller 17, the side sealing members 55 may be disposed so that their inner side edges are within regions in which the attractive effect of the magnetism of the magnet roller 17 is not very significant. In this case, part of the layer of the developer 56 lightly rubs against the inner sides of the side sealing members 55. However, the side sealing members 55 are not abraded by the developer 56 because the magnetic carrier and the magnetic toner are attracted to the circumference of the developing sleeve 18 by a relatively low magnetic attraction. Furthermore, even if the developer 56 spreads into gaps between the circumference of the developing sleeve 18 and the side sealing members 55, the developer 56 is not pressed against the developing sleeve 18 by the side sealing members 55 as hard as the developer 56 sticks to the developing sleeve 18. Therefore, the excessively rapid wear of the side sealing members 55 and the adverse effect of the developer 56 sticking to the developing sleeve 18 can be prevented.

A step 57 extending parallel to a shaft 17*a* supporting the magnet roller 17 is formed in the front edge of the bottom wall 29*b* of the developing device case 29 defining the bottom of the open chamber 53 as shown in FIGS. 5 and 6, and the trimming blade 33 is set on a bottom sealing strip 58 of sponge or the like attached to the step 57 so that a gap S of about 300 μm is formed between the upper edge of the trimming blade 33 and the circumference of the developing sleeve 18 to regulate the thickness of the layer of the developer formed on the circumference of the developing sleeve 18.

The left end of the trimming blade 33 is inserted in a rectangular opening 60*a* (FIGS. 4 and 5) formed in a side wall 59*a* integral with the left sealing wall 53*a* of the developing device case 29 and is fastened to the rear surface of a holding part of the side wall 59*a* with a screw 61*a*. A trimming blade holding member 59*b* provided with a rectangular opening 60*b* (FIG. 4) is fastened to the outer surface of the side wall of the developing device case 29 with a screw 61*b* to receive the right end of the trimming blade 33 in the rectangular opening 60*b*. Therefore, the position of the right end of the trimming blade 33 with respect to the longitudinal direction may be within a predetermined range. When thus attaching the trimming blade 33 to the developing device case 29, the trimming blade 33 can be accurately positioned so that the gap S of a desired size is formed by placing the trimming blade 33 with the opposite ends of the upper edge thereof in contact with a pair of bearings rotatably supporting the developing sleeve 18, respectively.

An initial toner (initial developer), i.e., a mixture of magnetic carrier and magnetic toner, is put in the open chamber containing the developing sleeve 18 at the factory for test printing to test print quality.

This initial toner is liable to leak from the image forming unit 8 through a gap, which determines the thickness of the layer of the developer, defined by the lower end of each semicircular recess 54, inner edge of each side sealing member 55 and the upper edge of the trimming blade 33; that is, since the gap is formed at a position outside the region subject to the influence of the magnetism of the magnet roller 17 or in a region where the influence of the magnetism of the magnet roller 17 is insignificant, the magnetic carrier and the magnetic toner are liable to leak through the gap.

Figures 8A, 8B, 8C, 8D:
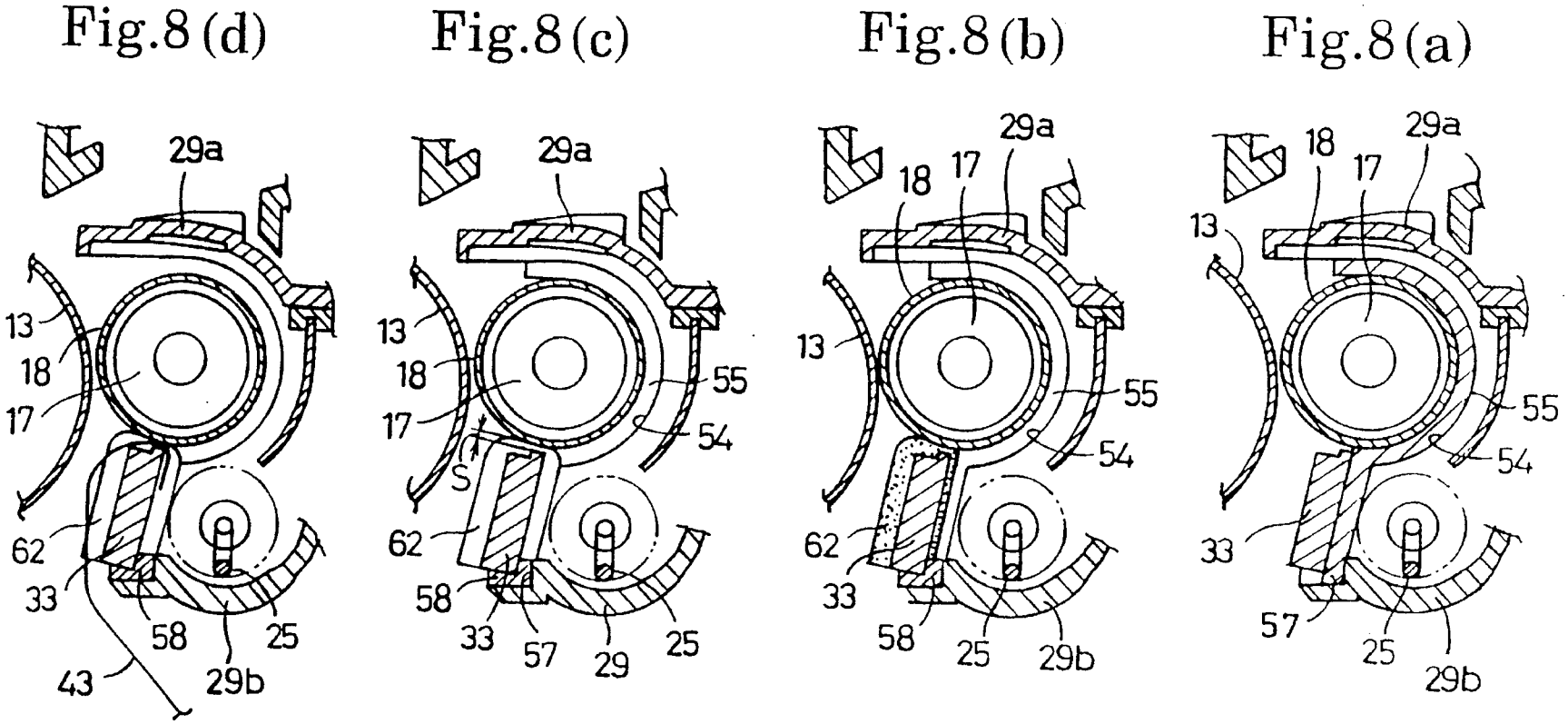
FIGS. 8(*a*), 8(*b*), 8(*c*) and 8(*d*) are sectional views taken on line $\mathbf{8}^{I}$—$\mathbf{8}^{I}$, line $\mathbf{8}^{II}$—$\mathbf{8}^{II}$, line $\mathbf{8}^{III}$—$\mathbf{8}^{III}$ and line $\mathbf{8}^{IV}$–$\mathbf{8}^{IV}$, respectively, in FIG. 6.

Auxiliary sealing members 62, 62 formed of synthetic resin sponge in the shape of an inverted U are attached adhesively with an adhesive or the like to the opposite ends, respectively, of the upper edge of the trimming blade 33 to prevent leakage of the magnetic carrier and the magnetic toner through the gaps. The auxiliary sealing members 62, 62 are disposed at positions corresponding to the recesses 54 limiting the opposite ends of the open chamber 53 so as to overlap the corresponding side sealing members 55 by a width H5, respectively, as shown in FIG. 6. Thus, when the trimming blade 33 is disposed in place, the gap defined by the lower end of each semicircular recess 54, the inner edge of each side sealing member 55 and the end of the upper edge of the trimming blade 33 is stopped with the upper part of the auxiliary sealing member 62 as shown in FIG. 8(*b*), so that the leakage of the initial toner, i.e., the initial developer, can be prevented.

Since the auxiliary sealing members 62, 62 are disposed at positions in regions outside the image forming region on the circumference of the photoconductive drum 13 with respect to the direction parallel to the axis of the photoconductive drum 13, respectively, the normal image forming operation is not hindered at all by the auxiliary sealing members 62, 62. Each auxiliary sealing member 62 is attached to the trimming blade 33 with the adhesive at a position outside a portion of the trimming blade 33 forming the gap S defining the thickness of the layer of the developer so that the layer of the adhesive formed between the auxiliary sealing member 62 and the trimming blade 33 may not accidentally protrude above the gap S to damage the circumference of the developing sleeve 18.

A cover is used to prevent leakage of the initial developer during transportation from the outer case 28 containing the developing device case 29 containing the photoconductive drum 13 and the initial developer. The cover comprises a protective sheet 43 (FIGS. 6 and 8(*d*)) to be removably inserted in the gap between the trimming blade 33 and the developing sleeve 18 to block the gap to cover the outer case 28. Ferromagnetic strips 64, 64, such as iron foil strips capable of being attracted by the magnetism of the magnet roller 17 are attached to one end of the reverse side of the protective sheet 43.

For example, as shown in FIG. 6, the protective sheet 43 of a soft synthetic resin, such as a polyethylene terephthalate film, has a width H6 substantially equal to or slightly smaller than the distance H7 between the auxiliary sealing members 62, 62, and the ferromagnetic strips 64, 64, i.e., the foil strips, are attached adhesively to the opposite ends, respectively, of one longitudinal end of the reverse side of the protective sheet 43 not in contact with the circumference of the developing sleeve 18.

The image forming unit 8 is wrapped up with the protective sheet 43 after the test printing operation of the image forming unit 8 in the factory. When wrapping the image forming unit 8 with the protective sheet 43, the longitudinal end of the protective sheet 43 is brought near to the gap between the upper edge of the trimming blade 33 and the circumference of the developing sleeve 18. After the portions of the protective sheet 43 provided with the ferromagnetic strip 64 have been attracted by the magnetism of the magnet roller 17 fitted in the developing sleeve 18, the protective sheet 43 is tucked along the circumference of the developing sleeve 18 into the developing device case 29. Although the obverse side of the protective sheet 43 is in direct contact with the circumference of the developing sleeve 18, the circumference of the developing sleeve 18 will not be damaged when tucking the protective sheet 43 into the developing device case 29 and when pulling out the same from the developing device case 29, because the ferromagnetic strips 64, 64 are attached to the reverse side of the protective sheet 43 and are not in direct contact with the circumference of the developing sleeve 18. Furthermore, since the protective sheet 43 extends over substantially the entire length of the gap between the upper edge of the trimming blade 33 and the circumference of the developing sleeve 18, leakage of the initial developer through the gap can be prevented. In particular, since the ferromagnetic strips 64, 64 are attached to the protective sheet 43 at positions near the inner sides of the auxiliary sealing members 62, 62, respectively, a mist of the developer (the magnetic carrier and the magnetic toner) produced by vibrations or the like during transportation and tending to leak through the gaps S near the auxiliary members 62, 62 is attracted to the ferromagnetic strips 64, 64 and unable to leak outside. Thus, both the sealing effect of the auxiliary sealing members 62, 62 and the developer arresting effect of the ferromagnetic strips 64, 64 prevent the leakage of the developer.

Even if a mist of the developer is produced and the developer, particularly, the comparatively hard magnetic carrier is attracted to the ferromagnetic strips 64, 64, there is no possibility that the circumference of the developing sleeve 18 will be damaged by the magnetic carrier adhering to the ferromagnetic strips 64, 64 when the protective sheet 43 is pulled off to use the image forming unit 8, because the ferromagnetic strips 64, 64 are attached to the reverse side of the protective sheet 43 not in contact with the circumference of the developing sleeve 18.

Furthermore, since the leading end of the protective sheet 43 can be securely held in the gap S by magnetically attracting the ferromagnetic strips 64, 64, the protective sheet 43 will not accidentally slip off the gap S during transportation, so that leakage of the developer can be prevented.

Figure 9:
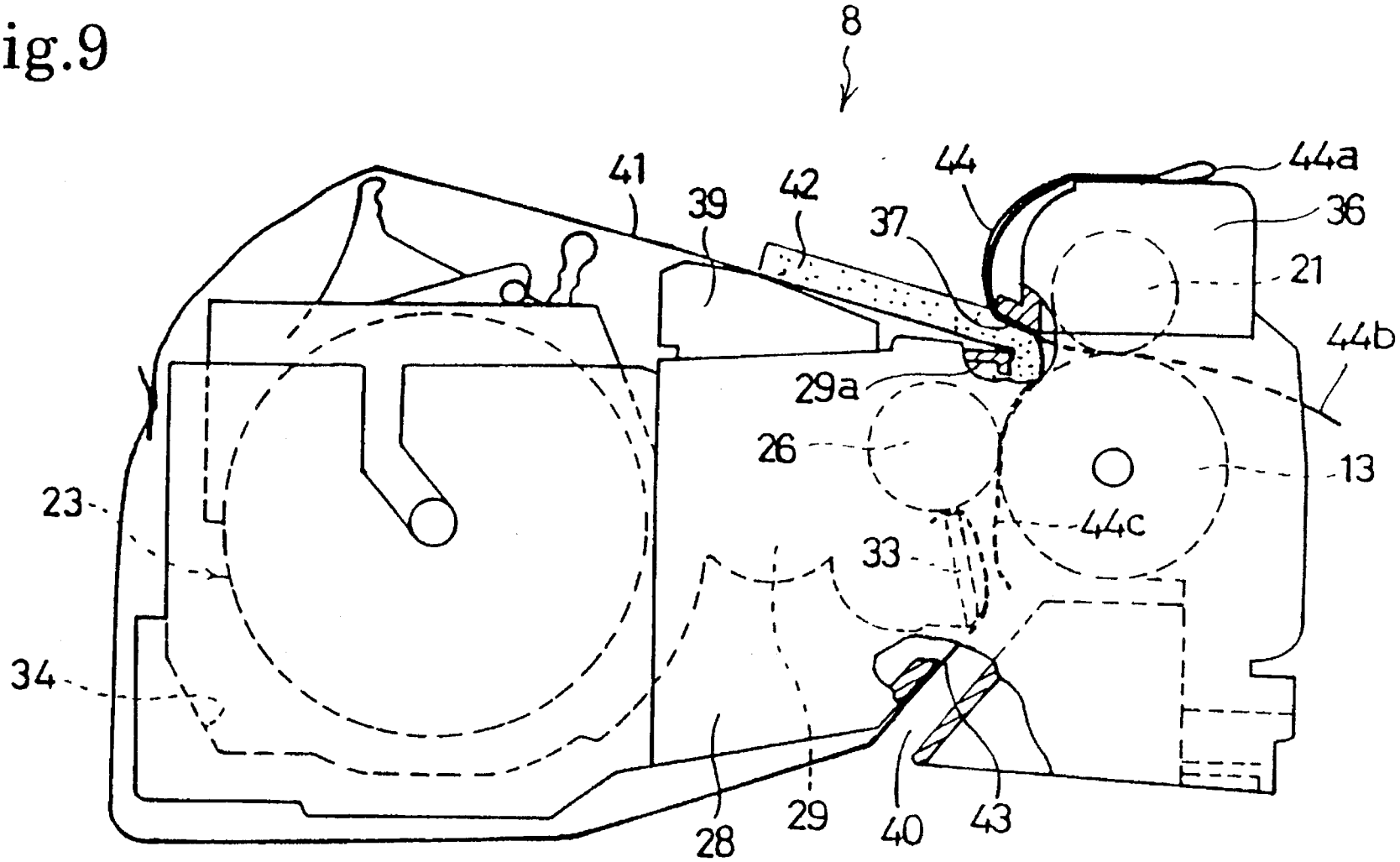
FIG. 9 is a part sectional view of a protective covering.
Figure 10:
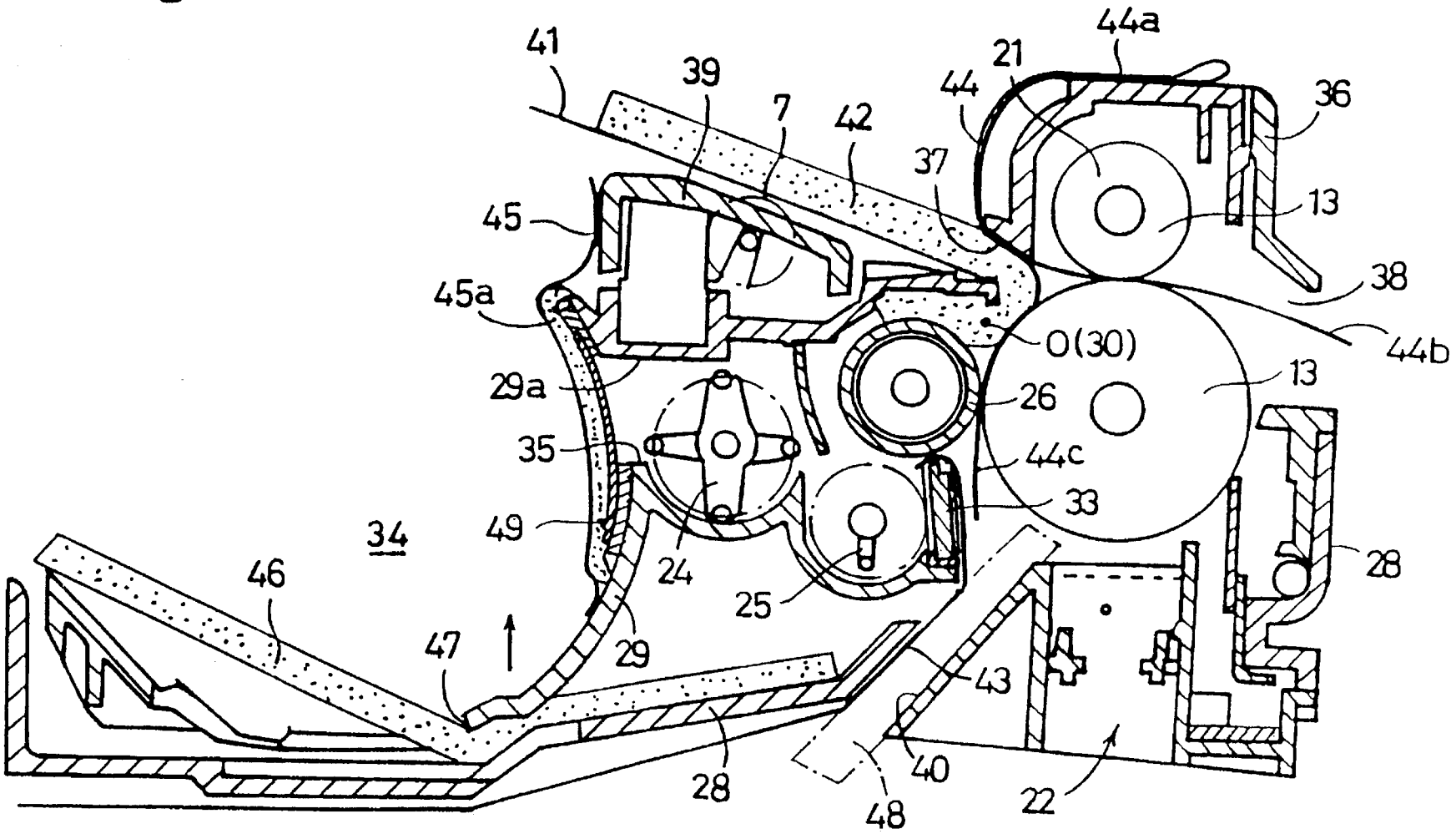
FIG. 10 is an enlarged sectional side view of the protective covering.
Figure 11:
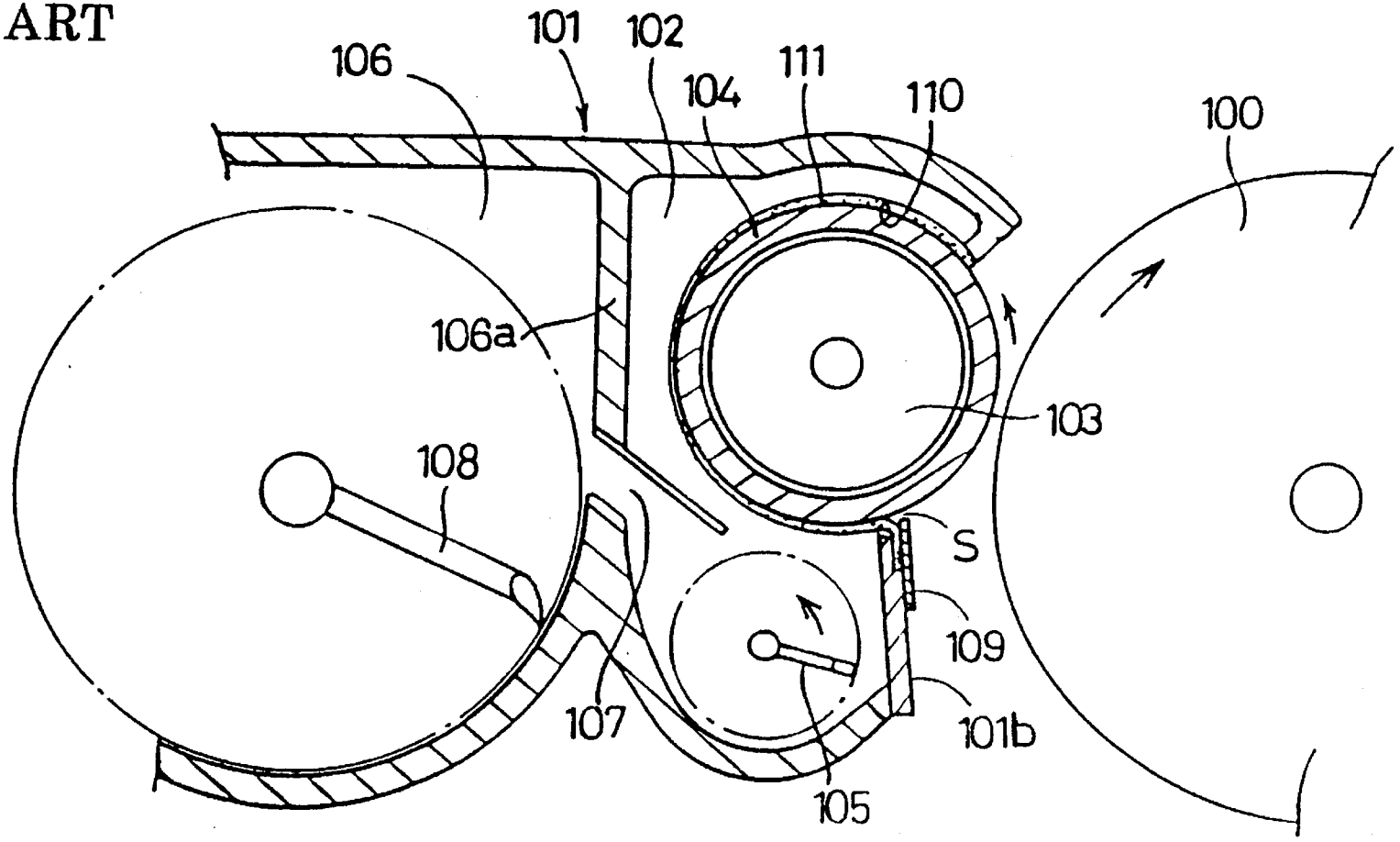
Fig.11 PRIOR ART
FIG. 11 is a fragmentary sectional side view of a developing device case included in a prior art image forming unit.
Figure 12:
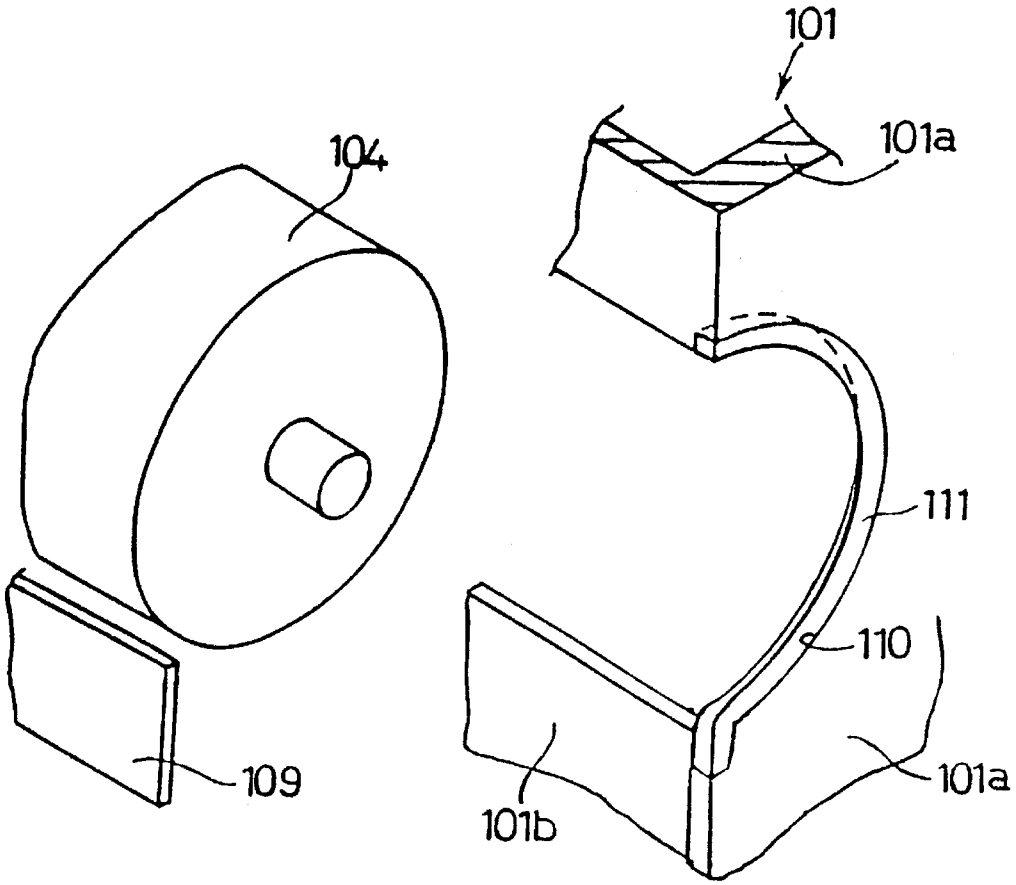
Fig.12 PRIOR ART
FIG. 12 is a fragmentary perspective view of the developing device case included in the prior art image forming unit.
Figure 13:
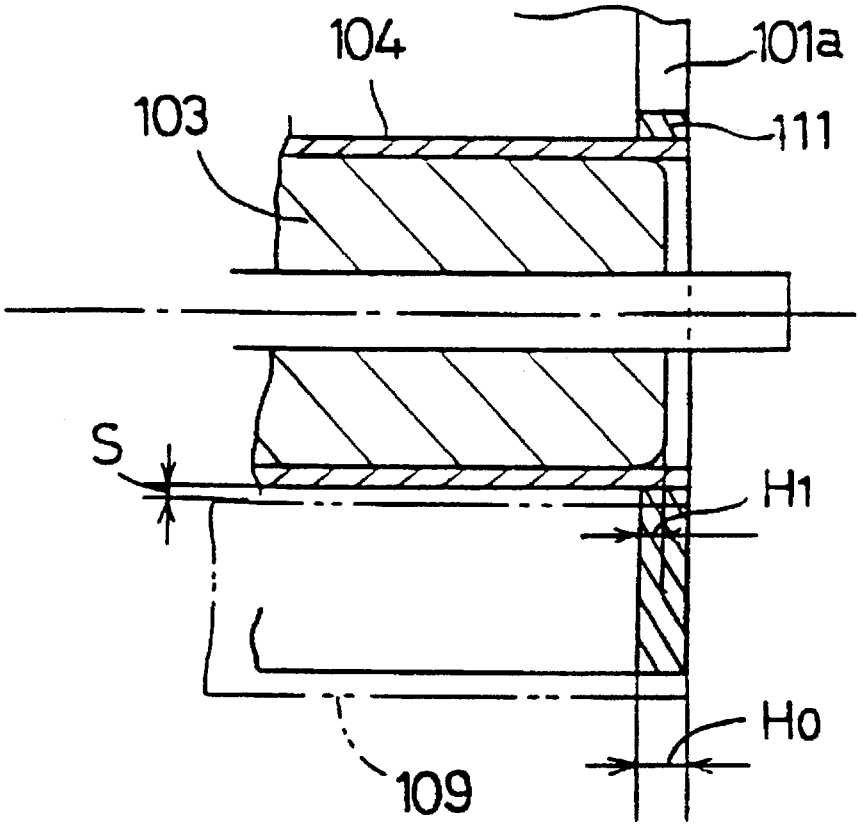
Fig.13 PRIOR ART
FIG. 13 is a fragmentary sectional view of a developing sleeve and the associated parts included in the prior art image forming unit.

When transporting the image forming unit 8, the image forming unit 8 is protected by a protective cover as shown in FIGS. 9 and 10.

Before transporting the image forming unit 8, the image forming unit 8 is taken out from the main case 2, the developing device case 29 is taken out from the outer case 28, a first stopping member 42, an upper protective sheet 41, the protective sheet 43 and an auxiliary sheet 44 are put on the developing device case 29, and the developing device case 29 is returned into the outer case 28.

As mentioned above, the flexible protective sheet 43, such as a synthetic resin film, is inserted in the gap between the developing sleeve 18 and the trimming blade 33 to block the gap between the developing sleeve 18 and the trimming blade 33. The free end of the protective sheet 43 extends outside through the exposure slot 40. The protective sheet 43 can be removed from the developing device case 29 by holding the free end extending outside the developing device case 29 with fingers and pulling the same.

The gap between the upper wall 29*a* of the developing device case 29, the photoconductive drum 13 and the developing sleeve 18 is blocked with the first stopping member 42 having the shape of an elongate plate and formed of an elastic material, such as sponge. The first stopping member 42 extends through the sheet inlet opening 37 over the upper surfaces of the upper wall 29*a* and the guide member 39. The first stopping member 42 can be removed from the developing device case 29 by holding the free end of the same with fingers and pulling the same.

One end of the upper protective sheet 41 is separably attached to the inner surface of the upper wall 29*a* of the developing device case 29 along the edge of the sheet inlet opening 37. A portion of the upper protective sheet 41 lies between the upper surface of the developing device case 29 and the first stopping member 42.

The upper protective sheet is a synthetic resin film or a tough thin paper sheet. The other end of the upper protective sheet 41 is attached to the free end of the protective sheet 43 with an adhesive or an adhesive tape to cover up most part of the image forming unit 8 with the upper protective sheet 41 and the protective sheet 43. The upper protective sheet 41 and the protective sheet 43 may be substituted by a single film.

The auxiliary protective sheet 44 is a synthetic resin film or a thin paper sheet. The auxiliary protective sheet 44 is folded in two, and the opposite end portions 44*b* and 44*c* of the auxiliary protective sheet 44 are held between the photoconductive drum 13 and the transfer roller 21 and between the photoconductive drum 13 and the developing sleeve 18, respectively. The doubled middle portion 44*a* of the auxiliary protective sheet 44 is attached to the upper surface of the protective member 36 with an adhesive or an adhesive tape. The doubled middle portion 44*a* is held between the protective member 36 defining the upper edge of the sheet inlet opening 37 and the first stopping member 42 to extend into the outer case 28. The end portion 44*b* held between the photoconductive drum 13 and the transfer roller 21 extends through the sheet outlet opening 38, and the other end portion 44*c* held between the photoconductive drum 13 and the developing sleeve 18 extends downward.

As shown in FIG. 2, a shutter 49 for shutting the elongate recess 35 is supported for sliding along the front wall of the toner cartridge chamber 34 of the developing device case 29. When the shutter 49 is opened after loading the toner cartridge 23 into the toner cartridge chamber 34, the developer is supplied through the elongate recess 35 from the toner cartridge 23. The shutter 49 is closed when the toner cartridge 23 is removed. As shown in FIG. 10, an elastic member 45*a* of sponge or the like is put on the shutter 49 to cover the shutter 49 entirely and is held in place with an adhesive tape 45 as shown in FIG. 10.

As shown in FIG. 10, a mat 46 of sponge or polyurethane is interposed between the bottom wall of the toner cartridge chamber 34 and the inner surface of the outer case 28. The developing device case 29 is turned about an axis O relative to the outer case 29 so that a clearance corresponding to the thickness of the mat 46 is formed between the outer case 28 and the developing device case 29 to separate the developing sleeve 18 from the photoconductive drum 13.

One end of the mat 46 extends through an opening 47 formed in the bottom wall of the toner cartridge chamber 34 into the outer case 29.

The mat 46 may be substituted by any member or any means capable of holding the developing device case 29 at a predetermined position relative to the outer case 28, i.e., a position to keep the developing sleeve 18 separated from the photoconductive drum 13.

Thus, the gap between the developing sleeve 18 and the trimming blade 33 is blocked with the protective sheet 43 provided with the ferromagnetic strips 64, 64, and the gap between the developing sleeve 18 and the upper surface of the developing device case 29 is blocked with the first stopping member 42 to prevent leakage of the developer from the cases during transportation.

Since portions of the first stopping member 42 and the protective sheet 43 extend outside through the openings 37 and 40, respectively, the first stopping member 42 and the protective sheet 43 can be removed from the image forming unit 8 simply by pulling the same. Since the sheet inlet opening 37, the photoconductive drum 13 and the transfer roller 21 are covered from the first stopping member 42 with the upper protective sheet 41 and the auxiliary protective sheet 44, the movement of the developer adhering to the first stopping member 42 to the periphery of the sheet inlet opening 37, the upper surface of the developing device case 29, the photoconductive drum 13 and the transfer roller 21 can be prevented when removing the first stopping member 42, and consequently, the sheet that comes into contact with those components during the image forming operation is not soiled with the developer.

As indicated by alternate long and short dash lines in FIG. 10, the exposure opening 40 formed in the outer case 28 may be blocked with a removable, elastic second stopping member 48 of sponge or the like to further ensure the prevention of leakage of the developer from the developing device case 29.

When the upper protective sheet 41 and the protective sheet 43 are joined together with an adhesive, or the upper protective film 41 and the protective sheet 43 are formed in a single film, it rarely occurs that only one of the sheets is removed and the other is left unremoved.

Although, the protective sheet 43 provided with the ferromagnetic strips 64, 64 is tucked into the gap between the auxiliary sealing members 62, 62 attached respectively to the opposite ends of the trimming blade 33 in this embodiment as shown in FIG. 6, the width of the protective sheet 43 may be slightly greater than the length of the gap between the auxiliary sealing members 62, 62, and the opposite transverse ends of the protective sheet 43 may overlap the auxiliary sealing members 62, 62, respectively. The auxiliary sealing members 62, 62 are partly compressed if the opposite transverse ends of the protective sheet 43 overlap the auxiliary sealing members 62, 62. The compression of the auxiliary sealing members 62, 62 does not affect the sealing effect of the auxiliary sealing members 62, 62.

What is claimed is:

1. An image forming unit, comprising:

a photoconductive drum;

a cylindrical developing sleeve internally provided with a magnet roller and supported for rotation in an open chamber formed in a developing device case, the magnet roller being disposed such that regions subject to the magnetism of opposite ends of the magnet roller are inside opposite ends of the developing sleeve;

substantially semicircular recesses formed in opposite side walls of the developing device case, the substantially semicircular recesses limiting opposite ends of the open chamber; and side sealing members extended along surfaces of the recesses in sliding contact with the opposite ends of the developing sleeve, respectively, the side sealing members being disposed outside the regions subject to the influence of the magnetism of the opposite ends of the magnet roller or inside regions where the influence of the magnetism of the opposite ends of the magnet roller is insignificant and further comprising a gap between an inner side of each of said side sealing members and a corresponding outer end of a developer.

2. The image forming unit according to claim 1, wherein the substantially semicircular recesses have a radius slightly greater than an outside radius of the developing sleeve.

3. The image forming unit according to claim 1, wherein the side sealing members comprise a strip-shaped member, said strip-shaped member being adhesively attached to each of the substantially semicircular recesses.

4. The image forming unit according to claim 1, further comprising a trimming blade disposed opposite the photoconductive drum with a gap between an edge thereof and the photoconductive drum.

5. The image forming unit according to claim 4, further comprising auxiliary sealing members attached to the trimming blade overlapping the side sealing members, respectively.

6. The image forming unit according to claim 4, further comprising a protective cover to prevent leakage of the developer during transportation, said protective cover comprising a protective sheet removably inserted in the gap between the trimming blade and the developing sleeve.

7. The image forming unit according to claim 6, wherein the protective sheet comprises ferromagnetic strips that are magnetically attracted by the magnetism of the magnet roller and attached to a side of the protective sheet opposite the developing sleeve.

8. An image forming unit comprising:

a photoconductive drum;

a cylindrical developing sleeve internally provided with a magnet roller and supported for rotation in an open chamber formed in a developing device case;

a trimming blade disposed opposite the developing sleeve with a gap between an edge thereof and the developing sleeve;

substantially semicircular recesses formed in opposite side walls of the developing device case, the substantially semicircular recesses limiting opposite ends of the open chamber;

side sealing members extended along the recesses in sliding contact with opposite ends of the developing sleeve, respectively; and auxiliary sealing members attached to the trimming blade overlapping the side sealing members, respectively.

9. The image forming unit according to claim 8, wherein a side of each side auxiliary sealing member toward a center of the developing sleeve is closer to the center of the developing sleeve than a side toward the center of the developing sleeve of the side sealing member with which overlapped.

10. The image forming unit according to claim 8, wherein the side sealing members are disposed outside regions subject to the influence of the magnetism of the opposite ends of the magnet roller or in regions where the influence of the magnetism of the opposite ends of the magnet roller is insignificant, the auxiliary sealing members being mounted on the trimming blade at positions inside the side sealing members, respectively.

11. The image forming unit according to claim 8, wherein the substantially semicircular recesses have a radius slightly greater than an outside radius of the developing sleeve.

12. The image forming unit according to claim 8, wherein the side sealing members comprise a strip-shaped member, said strip-shaped member being adhesively attached to each of the substantially semicircular recesses.

13. The image forming unit according to claim 8, further comprising a gap between an inner side of each of said side sealing members and a corresponding outer end of a developer.

14. The image forming unit according to claim 8, further comprising a protective cover to prevent leakage of the developer during transportation, said protective cover comprising a protective sheet removably inserted in the gap between the trimming blade and the developing sleeve.

15. The image forming unit according to claim 14, wherein the protective sheet comprises ferromagnetic strips that are magnetically attracted by the magnetism of the magnet roller and attached to a side of the protective sheet opposite the developing sleeve.

16. An image forming unit comprising:

a photoconductive drum;

a cylindrical developing sleeve internally provided with a magnet roller, the magnet roller being disposed such that regions subject to the magnetism of opposite ends of the magnet roller are inside opposite ends of the developing sleeve;

substantially semicircular recesses formed in opposite side walls of the developing device case, the substantially semicircular recesses limiting opposite ends of the open chamber; and means for sealing the developing sleeve and the substantially semicircular recesses, the sealing means being disposed outside the region subject to the influence of the magnetism of the opposite ends of the magnet roller or inside regions where the influence of the magnetism of the opposite ends of the magnet roller is insignificant, wherein said sealing means comprises side sealing members extended along surfaces of the recesses in sliding contact with the opposite ends of the developing sleeve, respectively and having a gap between an inner side of each of said side sealing members and a corresponding outer end of a developer.

17. The image forming unit according to claim 16, wherein the substantially semicircular recesses have a radius slightly greater than an outside radius of the developing sleeve.

18. The image forming unit according to claim 16, wherein the side sealing members comprise a strip-shaped member, said strip-shaped member being adhesively attached to each of the substantially semicircular recesses.

* * * * *